US005909808A

United States Patent [19]

Bartholomew

[11] Patent Number: 5,909,808

[45] **Date of Patent: *Jun. 8, 1999**

[54] CONTAINER FOR HORIZONTALLY STACKED SHEETS

[75] Inventor: David M. Bartholomew, Greensburg, Pa.

[73] Assignee: Menasha Corporation, Neenah, Wis.

[ * ] Notice: This patent is subject to a terminal disclaimer.

[21] Appl. No.: 08/962,823

[22] Filed: Nov. 3, 1997

Related U.S. Application Data

[63] Continuation-in-part of application No. 08/627,784, Mar. 27, 1996, Pat. No. 5,682,997.

[51] Int. Cl.[6] ..... B65D 85/48

[52] U.S. Cl. ..... 206/451; 206/454; 206/597

[58] Field of Search ..... 206/449–456, 206/499, 597

[56] References Cited

U.S. PATENT DOCUMENTS

| | | | |
|---|---|---|---|
| 1,714,692 | 5/1929 | Pagel et al. | 206/451 |
| 2,015,419 | 9/1935 | Ceely | 206/451 |
| 2,281,657 | 5/1942 | Aquino | 206/454 |
| 2,292,802 | 8/1942 | Steck et al. | 206/453 |
| 2,811,249 | 10/1957 | Swain et al. | 206/62 |
| 3,233,753 | 2/1966 | Rich | 214/10.5 |
| 3,403,777 | 10/1968 | Bucko | 206/62 |
| 3,485,351 | 12/1969 | Nixon | 206/451 |
| 3,547,457 | 12/1970 | Langer | 206/597 |
| 3,618,755 | 11/1971 | Kean, Sr. et al. | 206/454 |
| 3,645,389 | 2/1972 | Catiaux | 206/62 |
| 4,014,435 | 3/1977 | Rowley et al. | 206/454 |
| 4,019,634 | 4/1977 | Bonnot | 206/386 |
| 4,467,922 | 8/1984 | Rowley | 206/597 |
| 4,512,473 | 4/1985 | Thomaswick et al. | 206/454 |
| 4,960,209 | 10/1990 | Tudor | 206/451 |

OTHER PUBLICATIONS

Applicant's Exhibit 1, collection of photographs showing admitted prior art container designs.

*Primary Examiner*—Jim Foster
*Attorney, Agent, or Firm*—Quarles & Brady

[57] ABSTRACT

A container for storing and shipping a stack of glass sheets on edge sandwiches the sheets between a lower baseboard and an upper cap board, the stack and boards being enveloped by corrugated front and rear covers. Side flaps of the covers are secured to each other to prevent racking of the stack and vertical banding is provided around the covers. The cap board extends beyond the side flaps for handling by a sling with the banding supporting the stack from the cap board, and the baseboard is supported on feet for handling by a forklift. The cap board and front and corrugated covering may be provided in one piece which spans the entire stack or in two pieces with the pieces at opposite ends of the stack and the stack exposed between them.

18 Claims, 7 Drawing Sheets

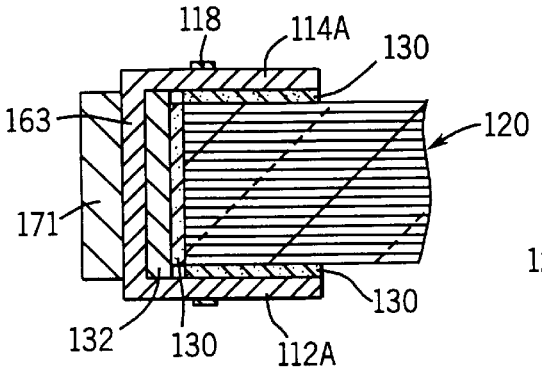
FIG. 10
FIG. 11
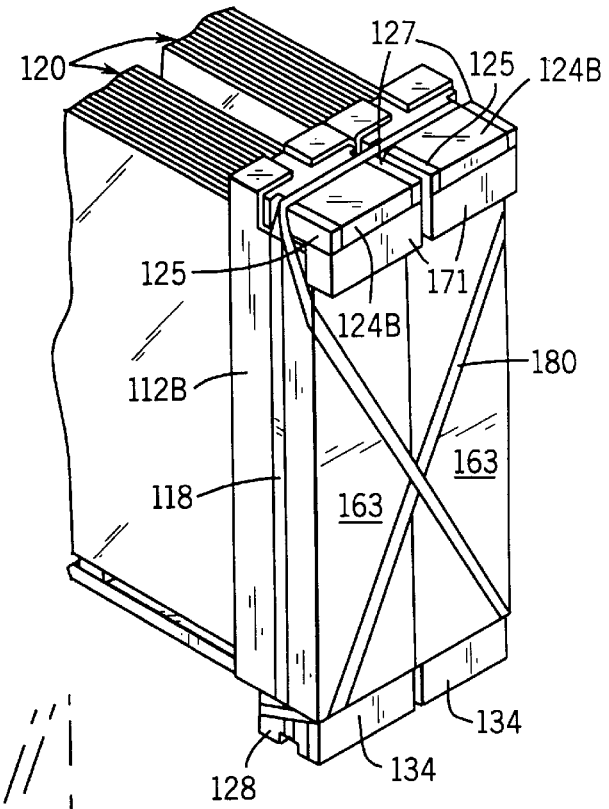
FIG. 12
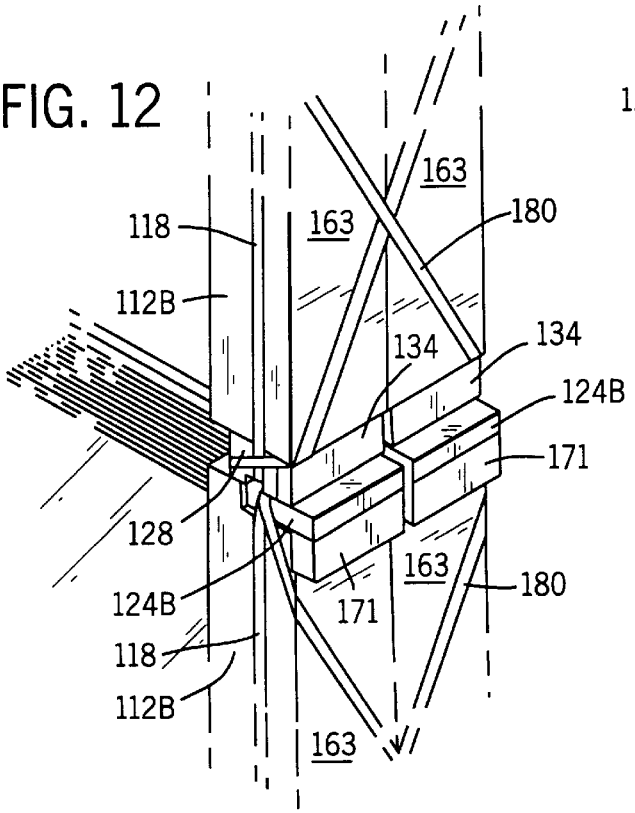

CONTAINER FOR HORIZONTALLY STACKED SHEETS

This is a continuation-in-part of U.S. Pat. application Ser. No. 08/627,784 filed Mar. 27, 1996, which issued Nov. 4, 1997 as U.S. Pat. No. 5,682,997.

BACKGROUND OF THE INVENTION

1. Field of the Invention

This invention relates to storage and shipping containers, and in particular to a container for storing and shipping flat sheets or panels vertically oriented on edge in a horizontal stack, and especially glass lites.

2. Discussion of the Prior Art

Sheets, and in particular glass sheets, often referred to as lites, are oftentimes shipped in horizontal stacks, in which a number of lites are vertically oriented on edge. Particularly for lites, there is a very low co-efficient of friction between adjacent lites, so the horizontal stack tends to rack transversely, i.e. to go from a rectangular or slightly trapezoidal cross-section to being more trapezoidal. Once racking begins, it is difficult to stop, the effects of gravity being what they are.

Containers for such horizontal stacks have typically supported at least one wall of the container vertically so as to prevent the stack from racking and ultimately falling over. Such a container is disclosed, for example, in U.S. Pat. No. 4,467,922 issued Aug. 28, 1984. In this container, a vertical back wall is secured upright to a horizontal base and reinforced in position by diagonally running elongate tension members, to keep the back wall from falling backward. The lites extend above a lower container section which encircles the horizontal stack. The base is a pallet so it can be handled by mechanized handling equipment. The containers can be stacked one on the other, with the upper pallets supported on top of the glass lites in the lower containers.

Since some sheet materials such as glass, ceramics or glass ceramics can be easily chipped or broken, it is desirable to give a high degree of protection from outside forces or completely enclose a stack of such sheets in the container. It is also desirable that multiple containers, although they can be very heavy, can be stacked one on top of the other, and it is desirable that the containers can be handled by a variety of mechanized or automated handling equipment, such as either a forklift truck or an overhead wire rope or chain sling. In addition, the container should provide support against racking of the stack either frontward or backward, and so that the container maintains a substantially rectangular parallelepiped shape.

SUMMARY OF THE INVENTION

The present invention provides a container for a horizontal stack of sheets which satisfies the above needs in an economical manner using commonly available materials. A container of the invention has a baseboard beneath a lower edge surface of the stack spanning the length of the lower edge surface and being of a width at least equal to the width of the lower edge surface. A cap board above an upper edge of the stack is of a width approximately equal to the width of the baseboard. A front cover has a front panel substantially parallel with and overlying one facing surface of the stack and a rear cover has a rear panel substantially parallel with and overlying the other facing surface of the stack. Side flaps or panels extend between the front and rear panels, and the container is vertically banded. As such, the container encloses the vertical edges and the corners of the stack, and the side flaps or panels prevent forward and rearward racking of the stack.

The cap board may extend all the way from side to side of the stack, or may be absent between its ends, so that it is made of two separate sections adjacent to the upper corners of the stack. In this form, the front and rear covers also may be absent between the ends of the stack, so that each cover is comprised of two sections. In fact, the front and rear cover sections, and the end panels at each end, may be made integral from a single folded sheet in this form.

In a preferred form, the cap board extends beyond the side flaps, so as to be hooked under by a wire rope or chain sling for handling by an overhead crane or conveyor. In addition, a side board can be affixed under the cap board at the side of the container and the rope or sling hooked under it for handling. In either case, the banding serves to suspend the stack and the remainder of the container from the cap board. Optionally, a vertical band may be added in the embodiment in which the center part of the stack is exposed, which serves to keep the stack together in the middle and also binds the stack to the base board so that structurally they behave as a single unit to support loads applied to the base board, particularly in handling and stacking. Feet may be provided below the baseboard for forklift handling of the container.

In another useful aspect, side boards are provided between the side panels and the stack. These serve to cushion and space the stack from the ends of the container, help "square up" the container, and provide a foundation to which to affix a side board. Padding is also preferably provided between the boards and all edges of the stack, and between the container and the front and rear of the stack.

Other features and advantages of the invention will also be apparent from the detailed description and drawings.

BRIEF DESCRIPTION OF THE DRAWINGS

FIG. 10 is a cross-sectional view along the plane of the line 10—10 of FIG. 7;

FIG. 11 is a partial end perspective view of two of the containers of FIG. 5 banded together; and FIG. 12 is a partial end perspective view of a stack of the packages shown in FIG. 11.

DETAILED DESCRIPTION OF THE PREFERRED EMBODIMENTS

Figure 1:
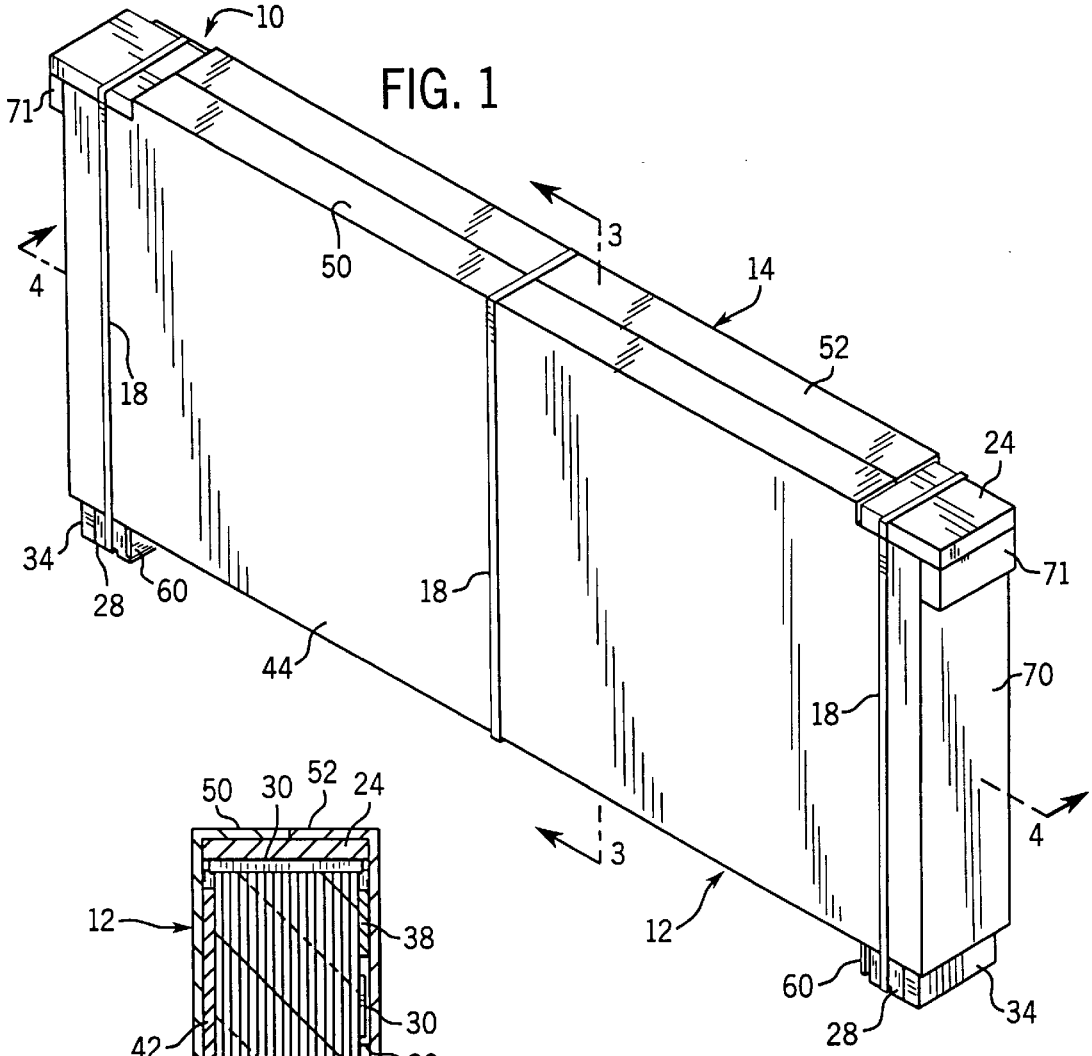
FIG. 1 is a perspective view of a container of the invention.
Figure 2:
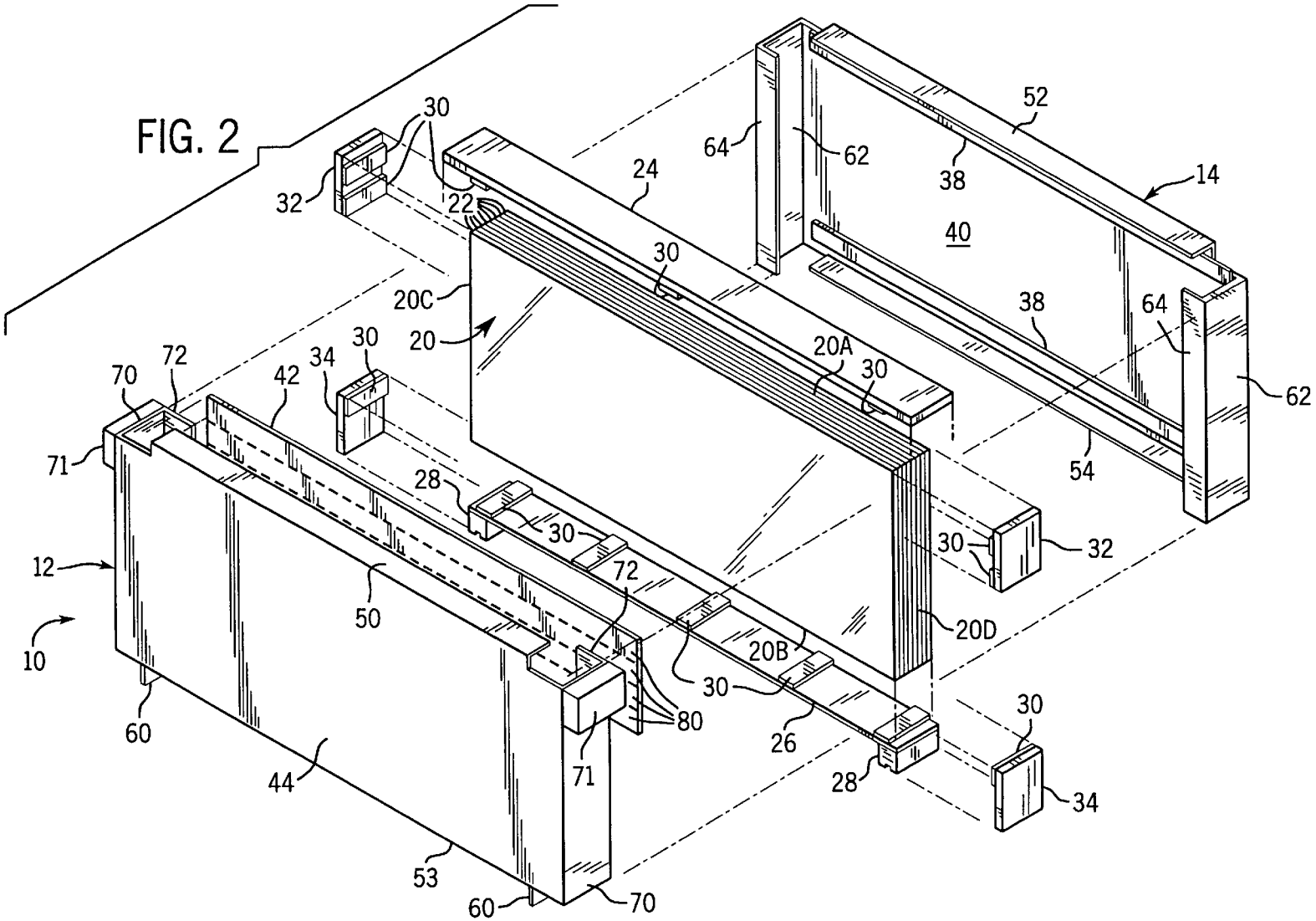
FIG. 2 is an exploded perspective view of the container of FIG. 1.

Referring to FIGS. 1 and 2, a container 10 of the invention has a front cover 12, a rear cover 14 and strapping or banding 18 (3 straps or bands to be exact) transversely encircling the container. Inside of the covers 12 and 14 above the upper edge surface 20A of a stack 20 of glass lites 22, a cap board 24 spans the length of the surface 20A and beyond and is of a width in the transverse direction which is approximately equal to the width of a base board 26 which spans the length of a bottom edge surface 20B of the stack 20 beneath the stack 20. A foot 28 extends downwardly from each end of the baseboard 26 to support the baseboard 26 above ground level so that the forks of a forklift truck may be inserted beneath the container 10.

At each side surface 20C and 20D of the stack 20, upper 32 and lower 34 side boards of a width substantially equal to the width of the baseboard 26 are positioned between the sides 20C and 20D of the stack 20 and the rear cover 14. During truck or other shipment, a 2 by 4 or other board or bracing may be nailed to the side boards 32 at an angle or otherwise, to help keep the package 10 from falling over. Also, the side boards 32, 34 help support the corners for "belly banding" if it is used (not shown), i.e., banding running around the package in a horizontal plane. In addition, it may be desirable during shipment to strap or bind several packages 10 together in front to back facing relationship to each other, which can be done.

Figure 4:
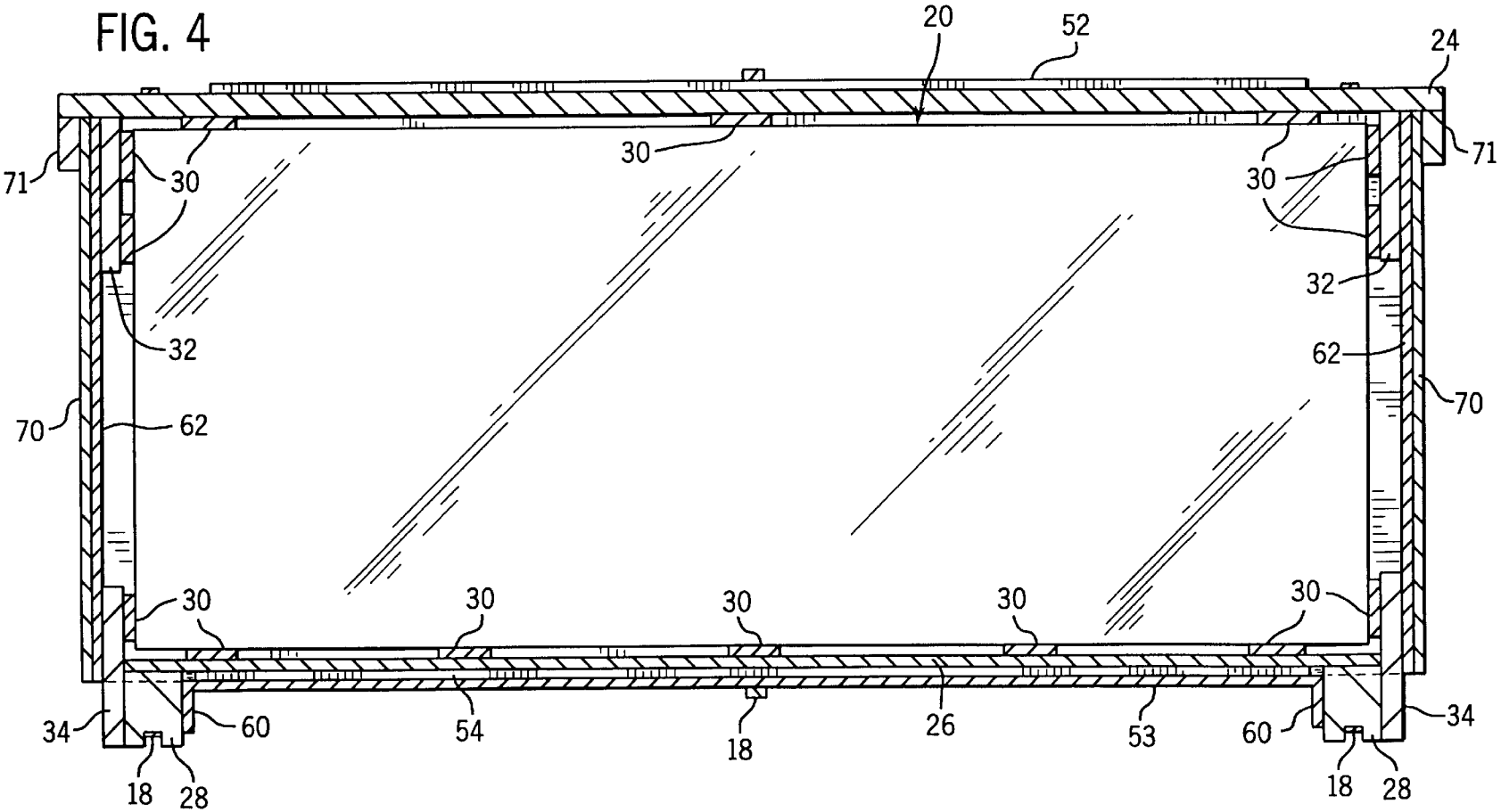
FIG. 4 is a cross-sectional view along the plane of the line 4—4 of FIG. 1.
Figure 5:
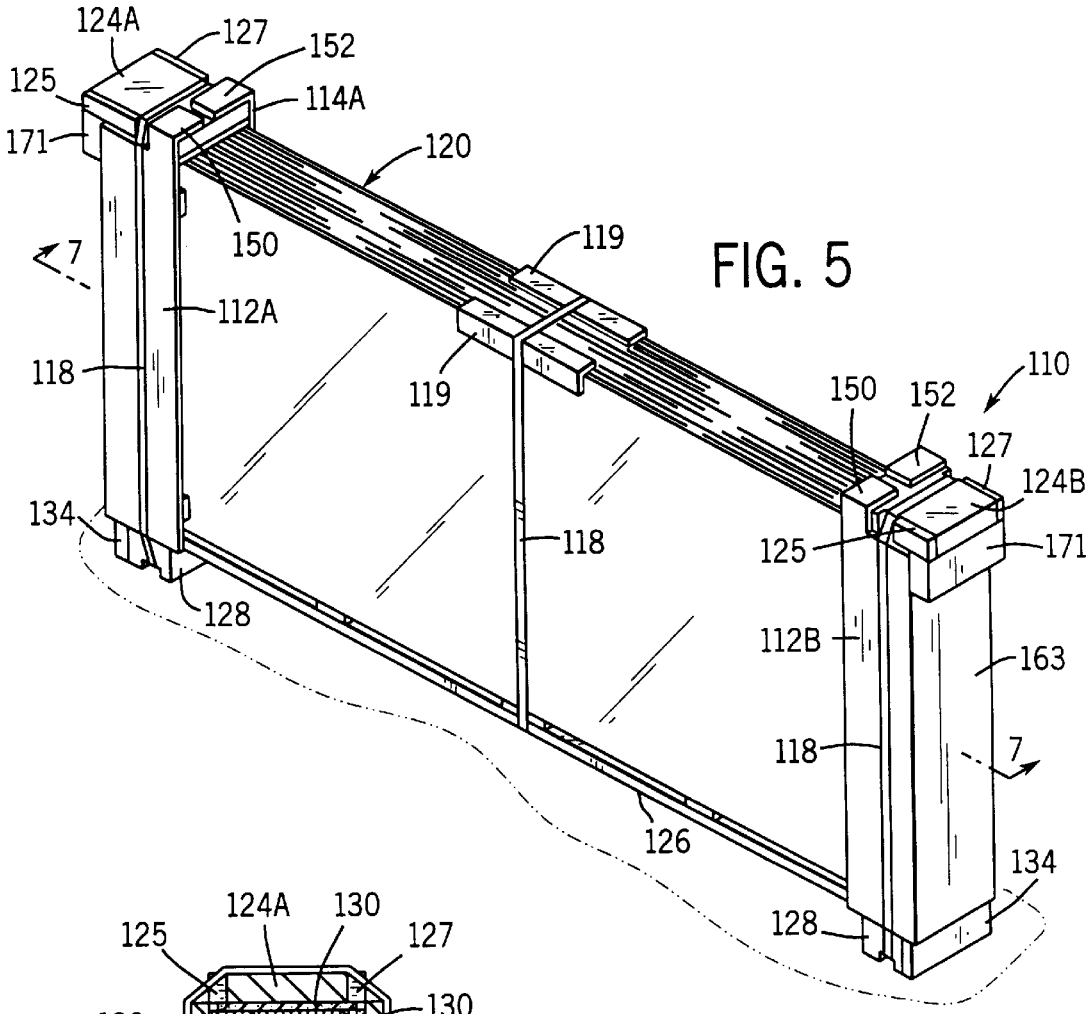
FIG. 5 is a perspective view of a second embodiment of a container of the invention.
Figure 8:
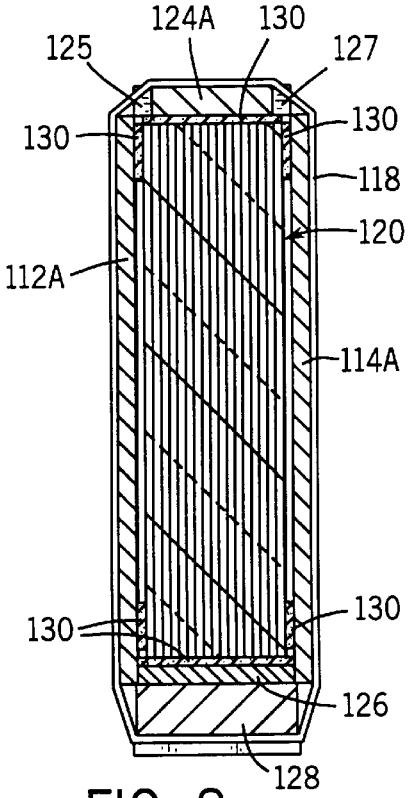
FIG. 8 is a cross-sectional view along the plane of the line 8—8 of FIG. 7.
Figure 9:
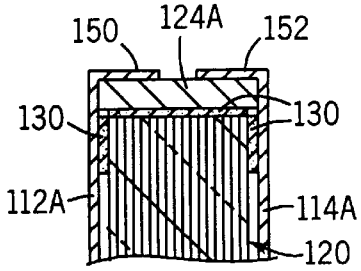
FIG. 9 is a cross-sectional view along the plane of the line 9—9 of FIG. 7.

Padding strips 30 are provided between the cap board 24, the baseboard 26, and the sideboards 32 and 34, and the edge surfaces 20A–D of the stack 20. Spacers-padding strips 38 are secured (e.g. by an adhesive) on the inside surface of the rear panel 40 of the rear cover 14 and an adjustable spacer/padding panel 42 is secured (e.g. by an adhesive) on the inside face of the front panel 44 of the cover 12. The lower sideboards 34 extend down along the outside surfaces of the feet 28 (FIGS. 1, 2 and 4) and are nailed to the feet 28.

The covers 12 and 14 have respective top flaps 50 and 52 which are folded over the cap board 24 and have inside edges which face one another approximately in the middle of the container 10. The covers 12 and 14 also have respective bottom flaps 53 and 54, the flap 54 being about as wide as the top flap 52 of the cover 14, and the flap 53 spanning substantially the entire thickness of the container 10, and having end flaps 60 which are folded downwardly and stapled or otherwise secured to the inside surface of the adjacent feet 28.

The bottom flaps 53 and 54 are preferably stapled to the baseboard 26 and the top flaps 50 and 52 are preferably stapled to the cap board 24. The side boards 32 and 34 are stapled to the adjacent side flap 62 which is folded forwardly from the adjacent end of the rear panel 40 of the rear cover 14. An end flap 64 is folded inwardly at the front edge of each side flap 62.

The cap board 24 is typically made of wood and is preferably a "2 by" board, i.e., it is actually one and one half inches thick, for example a standard two by four, two by six, two by eight, etc., the width of the board depending on the desired thickness of the container 10. The cap board 24 extends outwardly beyond the side flaps 62 and 70 so that its projecting ends may be hooked under by a sling to lift the container 10 by an overhead crane type of conveyor. Preferably, wood blocks 71 (e.g., 2 by 4 material) are nailed through the flaps 70 into the side boards 32 to help spread the sling load over the width of the projecting ends of the cap board 24.

The front cover 12 has side flaps 70 which are folded rearwardly along the end edges of the front panel 44 of the cover 12 so as to overly the adjacent side flaps 62. End flaps 72 are folded inwardly along the rearward edges of the side flaps 70 to overlie the ends of the rear panel 40. The side flaps 70 are stapled, glued or otherwise suitably fixed to the adjacent side flaps 62. The end flaps 72 may also be glued to the rear panel 40 of the rear cover 14 and the end flaps 64 may be glued to the front panel 44 of the front cover 12.

The baseboard 26 is also preferably a wooden board, preferably is "1 by" material, i.e., it is three quarters inches thick, and may be for example, a one by four, one by six, one by eight, etc., similar in width to the cap board 24. The feet 28 are also preferably made of wood. The sideboards 32 and 34 are also typically wood, approximately ten inches high each, and approximately one-half inch to one and one-half inches thick. The spacer-padding 38 is preferably at least one-half inch thick hexacomb material (thickness depending on pack thickness) which is commercially available from Hexacomb, 458 Sackett Point Road, North Haven, Conn. 06473. The padding strips 30 are preferably strips of corrugated cardboard or similar padding material.

The spacer/padding panel 42 affixed to the inside surface of the front panel 44 of the cover 12 is adjustable so as to make up for variations in the thickness of the stack 20. The thickness of the stack 20 varies because there is a dimensional tolerance on the thickness of each lite so that when many lites are put together in a stack the tolerance deviations add up to result in a varying thickness of the stack.

Figure 3:
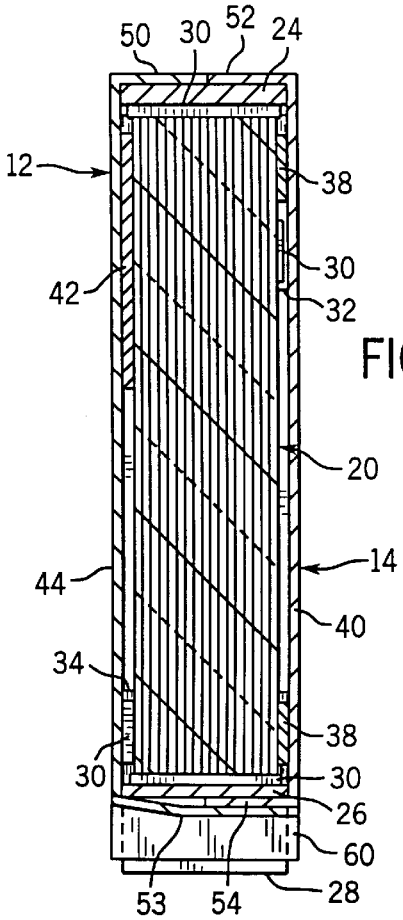
FIG. 3 is a cross-sectional view along the plane of the line 3—3 of FIG. 1.

Thus, the panel 42 is made approximately 16 inches in height with three score lines 80 provided at spaced intervals along its height. The score lines 80 divide the panel 42 into four subpanels, only the top one of which is adhered to the front panel 44. In the unfolded position shown (FIGS. 2 and 3), the container 10 can accommodate the maximum thickness of the stack 20. If the stack 20 is thinner than that, for example due to variations in the thicknesses of the lites 22, the spacer 42 is folded the requisite number of times on the score lines 80 to make up for the deficit in the thickness of the stack 20. The panel 42 may be folded once, twice or three times to make up for the deficit in thickness of the stack 20.

After the components of the container 10 shown in FIG. 2 are put together around a stack 20, it is banded vertically with steel or similar strapping material 18 in three places as shown in FIG. 1. The bands or straps 18 on the ends of the container 10 fit into grooves formed in the feet 28, and the central band 18 is at the halfway point along the length of the container 10.

The front and rear covers 12 and 14 are preferably made of corrugated paperboard material. This material is preferably double wall, with the outer liners being 69 pound, the inner liner being 36 pound, and the two flute layers being 26 pound medium. Other suitable materials having a requisite strength, stiffness and cushioning properties, could also be used. The corrugations of the material preferably run in the vertical direction, i.e. in the same direction as the bands 18.

In the container 10, the fixation of the side flaps 62 to the side flaps 70 supports the stack 10 against racking both forwardly and backwardly. For stacking, the stack 20 is protected by the cap board 24 and by the baseboard 26, as well as on the other four sides by the adjacent four sides of the container 10. Thus, one container 10 can be stacked on top of another without the upper container making direct contact with the lower stack 20. In addition, when stacking, each stack 20, which has considerable strength in vertical compression, supports the weight of the upper stacks.

FIGS. 5–10 illustrate a second preferred embodiment 110 of the invention which is essentially the same as the first embodiment 10, but with the changes illustrated and the changes described below. Corresponding parts of the container 110 have been identified with the same reference numeral as used in FIGS. 1–4, plus 100.

The main difference between the container 110 and the container 10 is that the corrugated covering and the cap board are removed between the ends of the container 110. Thus, the cap board 124 is provided in two pieces 124A and 124B, each above one of the upper corners of the stack 120 and having a portion which extends horizontally beyond the corner (as does the cap board 24) for being hooked under by a sling to lift the container. Outer side boards 171 are also provided in the container 110, nailed or stapled to upper side board 132, through side panel 163, to spread the sling load over the adjacent cap board piece 124A or 124B, when the sling is hooked under the board 171 and 124A or 124B. Front 125 and rear 127 boards (e.g., "1 by" material) are nailed or stapled to the front and rear of the cap board pieces 124A and 124B, which help keep the side banding 118 positioned over the top of the respective cap board piece 124A or 124B. The center band 118 is optional and, if provided, encircles the stack and runs beneath the base board 126, which is preferably "2 by" material in the container 110. Edge protectors 119 (e.g., corrugated paperboard) are preferably provided between the center band 118 and the upper edges of the stack 120 to protect the edges.

In the embodiment 110, the front 112 and rear 114 covers are each made in two side sections 112A and 112B and 114A and 114B, respectively, and the front and rear sections 112A and 114A and 112B and 114B at each side are integral with one another, each made from a single folded sheet of corrugated paperboard, with a side panel 163 extending between the respective connected covers 112A and 114A and between the respective connected covers 112B and 114B. In the embodiment 110, the material of the covers and side panels 163 is preferably triple wall (i.e., three fluted layers separated from one another by two inner liners, one on each side of the middle fluted layer, and with two outer liners, one at each outside surface) corrugated paperboard. The side sections have top flaps 150 and 152 inside of the outer bands 118, but do not have any bottom flaps corresponding to the flaps 53, 54 or 60 of the container 10, since the bands 118 serve to hold the covers 112 and 114 proximate to the base board 126. The bottoms of the covers 112A, B and 114A, B are also nailed, stapled or otherwise suitably affixed to the base board 126.

Figure 6:
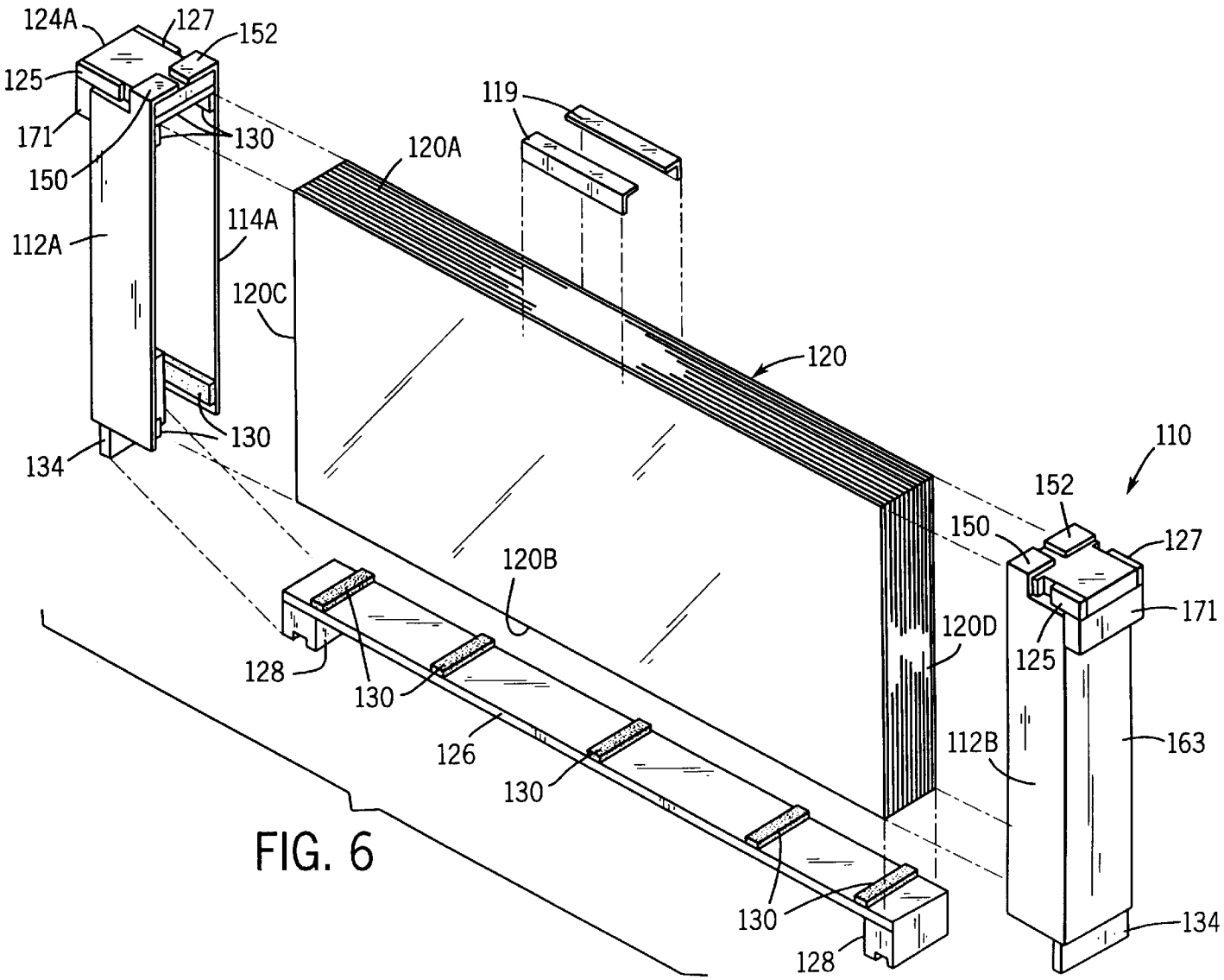
FIG. 6 is an exploded perspective view of the container of FIG. 5 (banding not shown)
Figure 7:
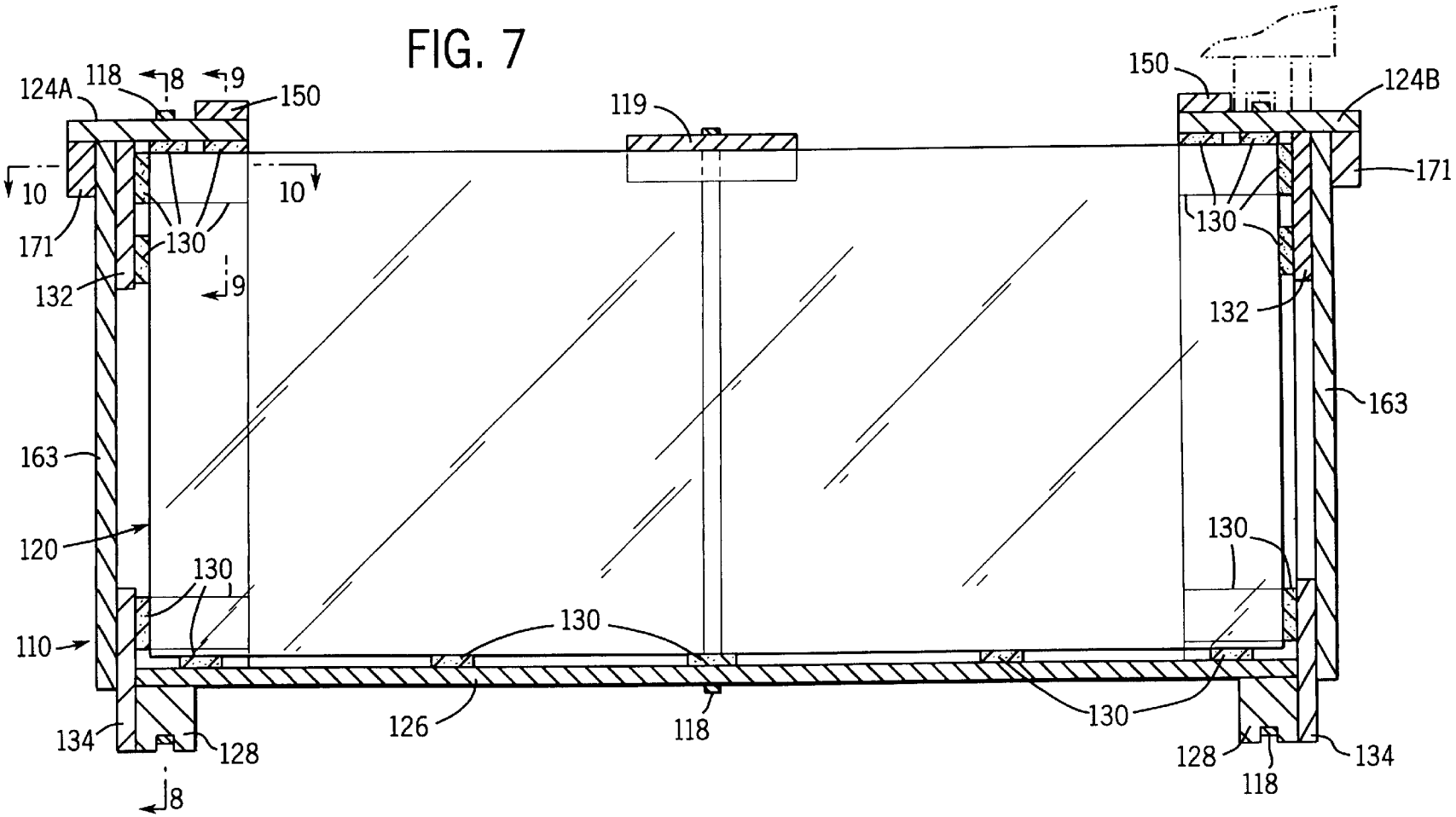
FIG. 7 is a cross-sectional view along the plane of the line 7—7 of FIG. 5.

Thus, the embodiment 110 essentially consists of three subassemblies. The three subassemblies are two identical end caps and one base board assembly. Each end cap is illustrated as a unit in FIG. 6. Each end cap unit is built from a single piece of corrugated paperboard which is scored and folded to form the front cover 112A or B, a side panel 163, the corresponding rear cover 114A or B and top flaps 150, 152, with the side boards 132, 134 and corresponding cap board 124A or B fixed to the paperboard, the front and rear boards 125, 127 fixed to the cap board, and the cap board and outer side board 171 fixed to the top side board 132, and with padding 130 affixed to the inside of the unit as illustrated. The base board subassembly is also as illustrated in FIG. 6, being made from the baseboard 126, feet 128 and padding 130. To assemble the end cap units to the base board unit, the bottom side boards 134 are nailed, stapled or otherwise affixed to the feet 128, and the end bands 118 serve to hold the top of the end cap units against the stack, which also holds them laterally adjacent to the ends of the stack.

FIGS. 11 and 12 illustrate how two of the containers 110 can be banded together by a band 180 to make a package which has less of a tendency to tip over or rack. The band 180 preferably forms an "X", as shown.

Preferred embodiments of the invention have been described in considerable detail. Many modifications and variations to the preferred embodiments will be apparent to those skilled in the art which will still incorporate the invention. Therefore, the invention should not be limited to the preferred embodiments described, but should be defined by the claims which follow.

I claim:

1. A container for storing and shipping sheets vertically oriented on edge in a horizontal stack, said stack having a forward facing surface, a rearward facing surface, and perimetral edge surfaces between said forward and rearward facing surfaces, said container comprising:

a baseboard beneath a lower edge surface of said stack spanning the length of said lower edge surface and being of a width approximately equal to the width of said lower edge surface;

at least one cap board above an upper edge of said stack of a width approximately equal to the width of said baseboard;

a front cover having a front panel substantially parallel with and overlying at least a portion of said forward facing surface of said stack;

a rear cover having a rear panel substantially parallel with and overlying, at least a portion of said rearwardly facing surface of said stack;

a side panel extending between and fixed to said front cover and rear cover; and vertical banding around said container encompassing said baseboard and said cap board with said stack between said baseboard and cap board;

wherein said cap board has an extending portion which extends beyond said side panel so that said banding suspends said baseboard and stack supported thereon when said cap board is lifted by a sling hooked under said extending portion.

2. A container as claimed in claim 1, wherein a side board is secured to said container at said side of said container beneath said portion of said cap board which extends beyond said side panel.

3. A container as claimed in claim 1, wherein each of said front and rear covers is provided in two side sections, with a space between said side sections.

4. A container as claimed in claim 3, further comprising another cap board above an upper edge of said stack of a width approximately equal to the width of said baseboard, each said cap board being positioned above an upper corner of said stack and having a portion which extends horizontally beyond said upper corner.

5. A container as claimed in claim 4, wherein said vertical banding is provided at the ends of said stack, around said front and rear cover side sections.

6. A container as claimed in claim 5, wherein said vertical banding further includes a vertical band around said stack between said front and rear cover side sections and said cap boards which extends beneath said base board.

7. A container as claimed in claim 5, together with a second container as claimed in claim 6, wherein both said containers are banded together.

8. A container as claimed in claim 1, wherein a foot extends downwardly from each end of said baseboard.

9. A container as claimed in claim 1, wherein side boards of a width substantially equal to the width of said baseboard are provided between said side panel and said stack.

10. A container as claimed in claim 3, wherein padding is provided between said sideboards and said stack.

11. A container as claimed in claim 1, wherein padding is provided between said front and rear panels and said stack.

12. A container as claimed in claim 1, wherein padding is provided between said cap board and said baseboard and said stack.

13. A container as claimed in claim 1, wherein said front and rear covers have bottom flaps beneath said baseboard.

14. A container as claimed in claim 1, wherein said front and rear covers are corrugated paperboard.

15. A container as claimed in claim 1, wherein said front and rear covers have top flaps folded over said cap board.

16. A container for storing and shipping sheets vertically oriented on edge in a horizontal stack, said stack having a forward facing surface, a rearward facing surface, and perimetral edge surfaces between said forward and rearward facing surfaces, said container comprising:

a baseboard beneath a lower edge surface of said stack spanning the length of said lower edge surface and being of a width approximately equal to the width of said lower edge surface; and two identical end cap units spaced apart and at opposite ends of said stack, each said end cap unit including:

a three sided folded paperboard cover wrapped around an adjacent end of said stack, said sides including a front panel, a rear panel and a side panel connecting said front and rear panels; and a cap board above an upper edge of said stack of a width approximately equal to the width of an upper edge of said stack, said cap board being secured to said cover; and vertical banding around said end cap units, said banding encompassing said cap board and said base board with said stack between said cap board and said baseboard.

17. A container as claimed in claim 16, wherein each said cap board has a portion which extends beyond said side panel.

18. A container as claimed in claim 16, wherein a foot extends downwardly from each end of said base board.

* * * * *